US007572099B2

(12) United States Patent
Addis

(10) Patent No.: US 7,572,099 B2
(45) Date of Patent: Aug. 11, 2009

(54) SEAL FOR TURBINE ENGINE

(75) Inventor: Mark E. Addis, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 377 days.

(21) Appl. No.: 11/481,453

(22) Filed: Jul. 6, 2006

(65) Prior Publication Data

US 2008/0008580 A1 Jan. 10, 2008

(51) Int. Cl.
*F01D 11/02* (2006.01)

(52) U.S. Cl. ..... 415/174.2; 415/174.5; 415/135; 277/413; 277/931

(58) Field of Classification Search ..... 415/174.2, 415/174.5, 135; 277/931, 637, 359, 360, 277/412, 413

See application file for complete search history.

(56) References Cited

U.S. PATENT DOCUMENTS 6,435,514 B1 * 8/2002 Aksit et al. ..... 277/355
6,840,519 B2 * 1/2005 Dinc et al. ..... 277/413
6,969,231 B2 * 11/2005 Ghasripoor et al. ..... 415/173.4
7,140,382 B2 * 11/2006 Kempf et al. ..... 137/337

* cited by examiner

*Primary Examiner*—Ninh H Nguyen
(74) *Attorney, Agent, or Firm*—Carlson, Gaskey & Olds

(57) ABSTRACT

A turbine engine includes a first turbine structure that supports a seal. The seal is movable within a recess of the first turbine structure. The seal is arranged in close proximity to a seal land of a second turbine structure for preventing a fluid from leaking past the seal and seal land. A thermal expansion member interconnects the first turbine structure and the seal. The thermal expansion member expands in response to an increase in temperature to move the seal toward the seal land preventing the typical enlarged gap between the seal and seal land resulting from thermal growth. In one example, the thermal expansion member, which is arranged at each opposing end of a seal segment, is a bimetallic coil spring supported on the first turbine structure by a cage. A free end of the coil spring is secured to the seal at the opposing end portions.

3 Claims, 1 Drawing Sheet

SEAL FOR TURBINE ENGINE

BACKGROUND OF THE INVENTION

This invention relates to an air seal that is suitable for use in, for example, a turbine engine.

Various linear and annular seals are used to prevent undesired fluid flow within, for example, a turbine engine. These seals are used to seal static and rotating structures within the engine. Typical types of seals include air seals, labyrinth seals, brush seals, knife-edge seals and honeycomb seals.

A typical seal arrangement within a turbine engine has the seal hard mounted or affixed to a support structure. As thermal growth of various components occurs within the turbine engine, the seal moves away from the seal land causing the seal to seal land gap to grow increasing fluid leakage across the seal. What is needed is a seal that remains in close proximity to the seal land during thermal growth of the turbine engine.

SUMMARY OF THE INVENTION

A turbine engine includes a first turbine structure that supports a seal. The seal is movable within a recess of the first turbine structure. The seal is arranged in close proximity to a seal land of a second turbine structure for preventing a fluid from leaking past the seal and seal land. A thermal expansion member interconnects the first turbine structure and the seal. The thermal expansion member expands in response to an increase in temperature to move the seal toward the seal land preventing the typical enlarged gap between the seal and seal land resulting from thermal growth. In one example, the thermal expansion member, which is arranged at each opposing end of a seal segment, is a bimetallic coil spring supported on the first turbine structure by a cage. A free end of the coil spring is secured to the seal at the opposing end portions.

Accordingly, a seal is provided that remains in close proximity to the seal land during thermal growth of the turbine engine.

These and other features of the present invention can be best understood from the following specification and drawings, the following of which is a brief description.

DETAILED DESCRIPTION OF THE PREFERRED EMBODIMENT

Figure 1:
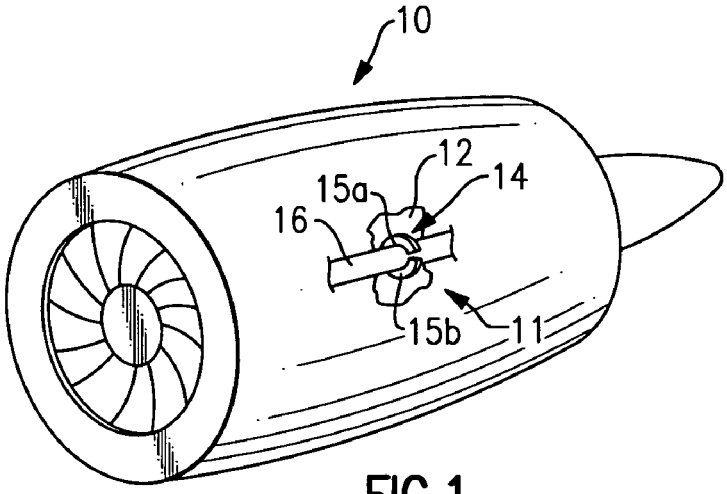
FIG. 1 is a schematic view of a turbine engine including an example seal arrangement.

A turbine engine 10 is schematically shown in FIG. 1. The turbine engine 10 includes a seal arrangement 11 having a support structure 12 such as a housing 13 (shown in FIG. 2). The seal 14 can include two or more segments 15*a*, 15*b* that create a seal about a seal land 16 such as a surface of a shaft. Of course, any number of segments can be used. The uniformity of clearance improves when more segments are employed. Of course, the seal 14 can be linear or annular in shape. Furthermore, the seal land 16 can be provided by any static or rotating structure. The seal 14 can be of any suitable type such as an air seal, labyrinth seal, brush seal, knife-edge seal or honeycomb seal.

Figure 2:
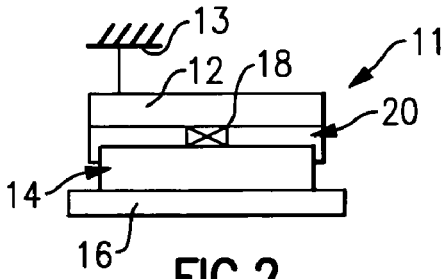
FIG. 2 is a schematic view of the example seal arrangement.

Referring to FIG. 2, a thermal expansion member 18 is schematically shown interconnecting the seal 14 to the support structure 12. The seal 14 is permitted to float relative to the support structure 12. A gap 20 is arranged between the seal 14 and support structure 12 to permit the seal 14 to move toward and away from the seal land 16.

Figure 3:
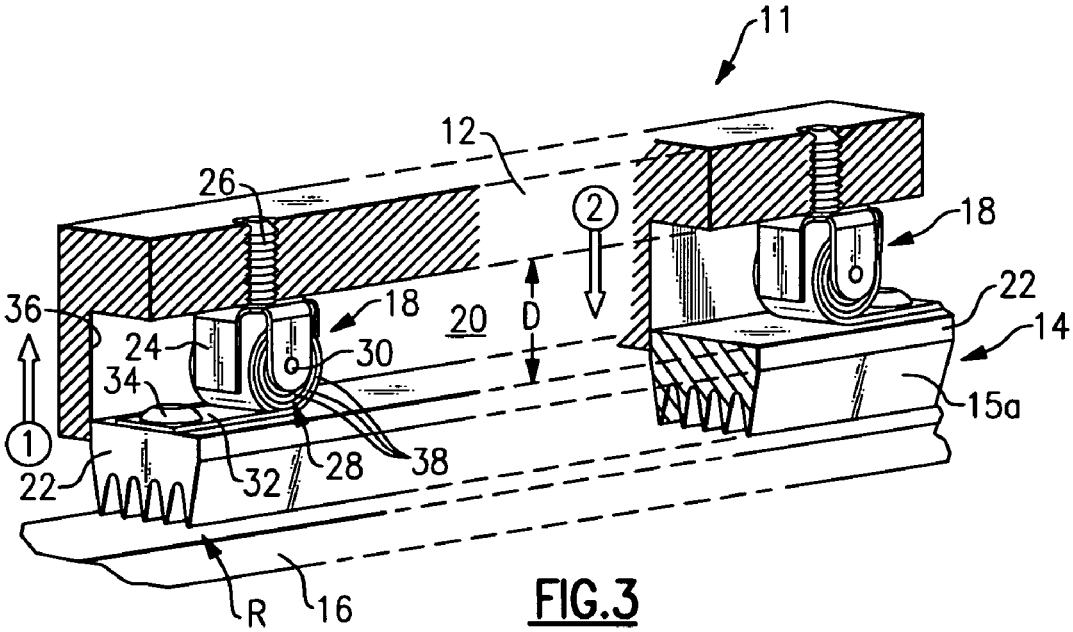
FIG. 3 is an enlarged, more detailed schematic view of an example seal arrangement.

One example seal arrangement 11 is shown schematically in more detail in FIG. 3. The segment 15*a* of the seal 14 provides opposing end portions 22. In the example shown, the thermal expansion member 18 is arranged at each of the opposing end portions 22 to provide adequate support for the segment 15*a*. The support structure 12 includes a recess 36 that receives and locates the seal 14. The gap 20 provides a distance D between the seal 14 and support structure 12. As the thermal expansion members 18 are exposed to increasing temperatures, the seal 14 moves in a direction 2 in response to growth of the thermal expansion members 18. As the temperature decreases, the seal 14 retracts into the recess 36 in the direction 1 in response to the retraction of the thermal expansion member 18.

In one example, the thermal expansion member 18 is constructed from a bimetallic material, as is well known in art. In the example shown, the bimetallic material is arranged in a coil spring configuration and supported by a cage 24 using a pin 30. The cage 24 ensures that the coils 38 move in a desired direction. The cage 24 is secured to the support structure by a threaded fastener 26, in the example shown. In other embodiments, the cage 24 is secured to the seal 14. The bimetallic material 28 is arranged in coils 38 and includes a free end 32 that is secured to the seal 14 using a fastener 34 such as a rivet. As the temperature increases, the coils 38 lengthen to move the seal 14 away from the support structure 12 and toward the seal land 16 to ensure that the seal 14 is in close proximity to the seal land 16 in a region R.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A seal arrangement for a turbine engine comprising:

support structure;

a seal in close proximity to a seal land spaced from the support structure for preventing a fluid from leaking past the seal and seal land;

a thermal expansion member interconnecting the support structure and the seal, the thermal expansion member expandable in response to an increasing temperature to move the seal toward the seal land;

wherein the seal includes first and second segments with at least one of the first and second segments having opposing end portions and a thermal expansion member arranged at each of the opposing end portions;

wherein the thermal expansion member includes a bimetallic material expandable in response to the increasing temperature;

wherein the thermal expansion member is a coil spring; and wherein the thermal expansion member includes a cage supporting the coil spring, the cage secured to one of the seal and the support structure.

2. The seal arrangement according to claim 1, wherein the coil spring includes a free end secured to the other of the seal and the support structure.

3. The seal arrangement according to claim 2, wherein the seal moves in a first direction away from the seal land, and the increasing temperature expands the thermal expansion member to move the seal in a second direction opposite the first direction toward the seal land.

* * * * *

UNITED STATES PATENT AND TRADEMARK OFFICE

CERTIFICATE OF CORRECTION

PATENT NO. : 7,572,099 B2
APPLICATION NO. : 11/481453
DATED : August 11, 2009
INVENTOR(S) : Mark E. Addis It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 413 days.

Signed and Sealed this

Seventh Day of September, 2010

David J. Kappos

David J. Kappos
*Director of the United States Patent and Trademark Office*